US008468961B2

(12) United States Patent
Tseng et al.

(10) Patent No.: US 8,468,961 B2
(45) Date of Patent: Jun. 25, 2013

(54) CLUTCH DEVICE FOR A NEEDLE BAR OF A SEWING MACHINE

(75) Inventors: Shui-Chun Tseng, Taichung Hsien (TW); Hsueh-Hua Liu, Taichung Hsien (TW); Ching-Lin Huang, Taichung Hsien (TW)

(73) Assignee: Zeng Hsing Industrial Co., Ltd., Taiping, Taichung Hsien (TW)

( * ) Notice: Subject to any disclaimer, the term of this patent is extended or adjusted under 35 U.S.C. 154(b) by 122 days.

(21) Appl. No.: 13/026,145

(22) Filed: Feb. 11, 2011

(65) Prior Publication Data

US 2012/0205215 A1 Aug. 16, 2012

(51) Int. Cl.
*D05B 55/16* (2006.01)
*F16D 11/00* (2006.01)

(52) U.S. Cl.
USPC ..... 112/221; 192/30 R

(58) Field of Classification Search
USPC ..... 112/98, 450, 270, 271, 284, 220, 112/221; 192/30 R, 83
See application file for complete search history.

(56) References Cited

U.S. PATENT DOCUMENTS

| | | | | | |
|---|---|---|---|---|---|
| 3,641,955 | A | * | 2/1972 | Brown et al. | 112/80.43 |
| 3,872,809 | A | * | 3/1975 | Adams et al. | 112/221 |
| 4,054,098 | A | * | 10/1977 | Hoever et al. | 112/86 |
| 4,254,721 | A | * | 3/1981 | Teetz et al. | 112/221 |
| 4,444,136 | A | * | 4/1984 | Slomma | 112/221 |
| 5,003,899 | A | * | 4/1991 | Ogawa | 112/221 |
| 5,339,757 | A | * | 8/1994 | Nakano et al. | 112/221 |

* cited by examiner

*Primary Examiner* — Ismael Izaguirre
(74) *Attorney, Agent, or Firm* — DLA Piper LLP (US)

(57) ABSTRACT

A clutch device used to couple/decouple a reciprocating force of a drive member to/from a needle bar in a sewing machine includes an actuating lever actuated by an electromechanical unit to be pivotable between an idle position to disengage from an actuated end of a clutch lever so as to leave a grasp end of the clutch lever in a coupled state, where the grasp end is engaged with a coupled portion disposed on a drive member, thereby transmit the reciprocating force to the needle bar, and an actuating position to be in pressing engagement with the actuated end so as to displace the grasp end to a decoupled state, where the grasp end is disengaged from the coupled portion.

3 Claims, 7 Drawing Sheets

CLUTCH DEVICE FOR A NEEDLE BAR OF A SEWING MACHINE

BACKGROUND OF THE INVENTION

1. Field of the Invention

This invention relates to a needle bar driving mechanism of a sewing machine, more particularly to a clutch device used to couple/decouple a reciprocating force of a drive member to/from a needle bar.

2. Description of the Related Art

A conventional sewing machine generally includes a driving source disposed for actuating a driving shaft to permit vertical reciprocation of a needle bar between upper and lower positions, and a cloth feeding unit disposed for feeding a work cloth in a feeding direction normal to the vertical reciprocation so as to perform a sewing operation. It is necessary for a sewing machine to perform an intermittent sewing operation to meet different sewing requirement or to produce a variety of sewing patterns. In this case, the needle bar should stop its vertical reciprocation while continuing on performing the cloth feeding process.

SUMMARY OF THE INVENTION

An object of the present invention is to provide a clutch device used to couple/decouple a reciprocating force to/from a needle bar during sewing operation of a sewing machine.

According to this invention, the clutch device includes a coupled portion disposed to be moved with a drive member between upper and lower positions, a clutch lever disposed to be pivotable relative to a needle bar and having actuated and grasp ends such that the grasp end is swingable by actuation of the actuated end between a coupled state, where the grasp end is engaged with the coupled portion under a biasing force, thereby transmitting the reciprocating force to move the needle bar, and a decoupled state, where the grasp end is disengaged from the coupled portion, a biasing member disposed to bias the grasp end to the coupled state with the biasing force, an actuating lever disposed to be pivotable relative to a machine head about a fulcrum axis, and having power and weight ends such that the weight end is swingable by actuation of the power end between an idle position, where the weight end is disengaged from the actuated end so as to leave the grasp end in the coupled state, and an actuating position, where the weight end is in pressing engagement with the actuated end against the biasing force, thereby displacing the grasp end to the decoupled state, and an electromechanical unit including a solenoid coil and a spring-loaded solenoid plunger which is configured to exert a pressing force on the power end so as to displace the weight end to the actuating position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
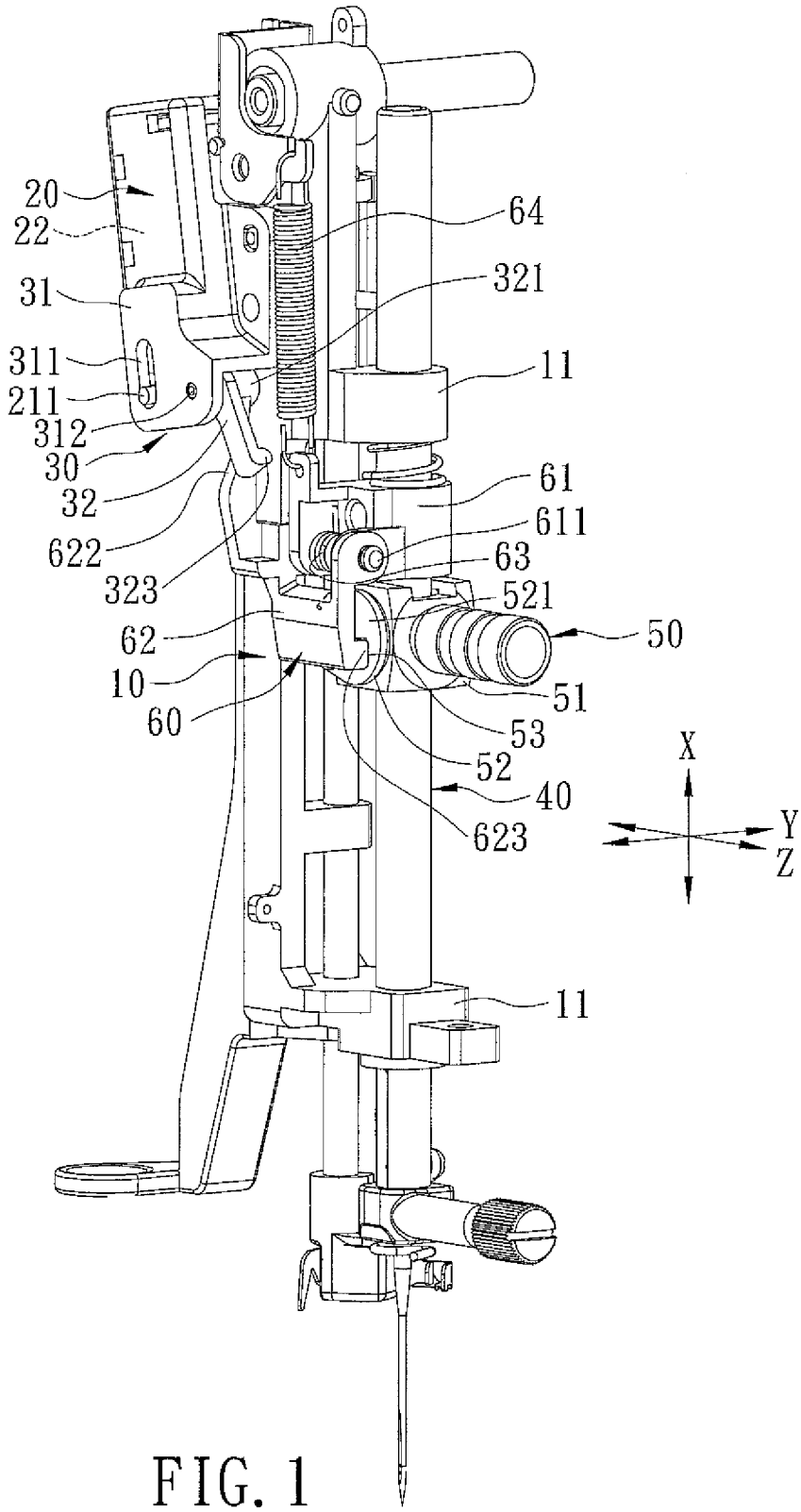
FIG. 1 is a perspective view of the preferred embodiment of a clutch device according to this invention.
Figure 2:
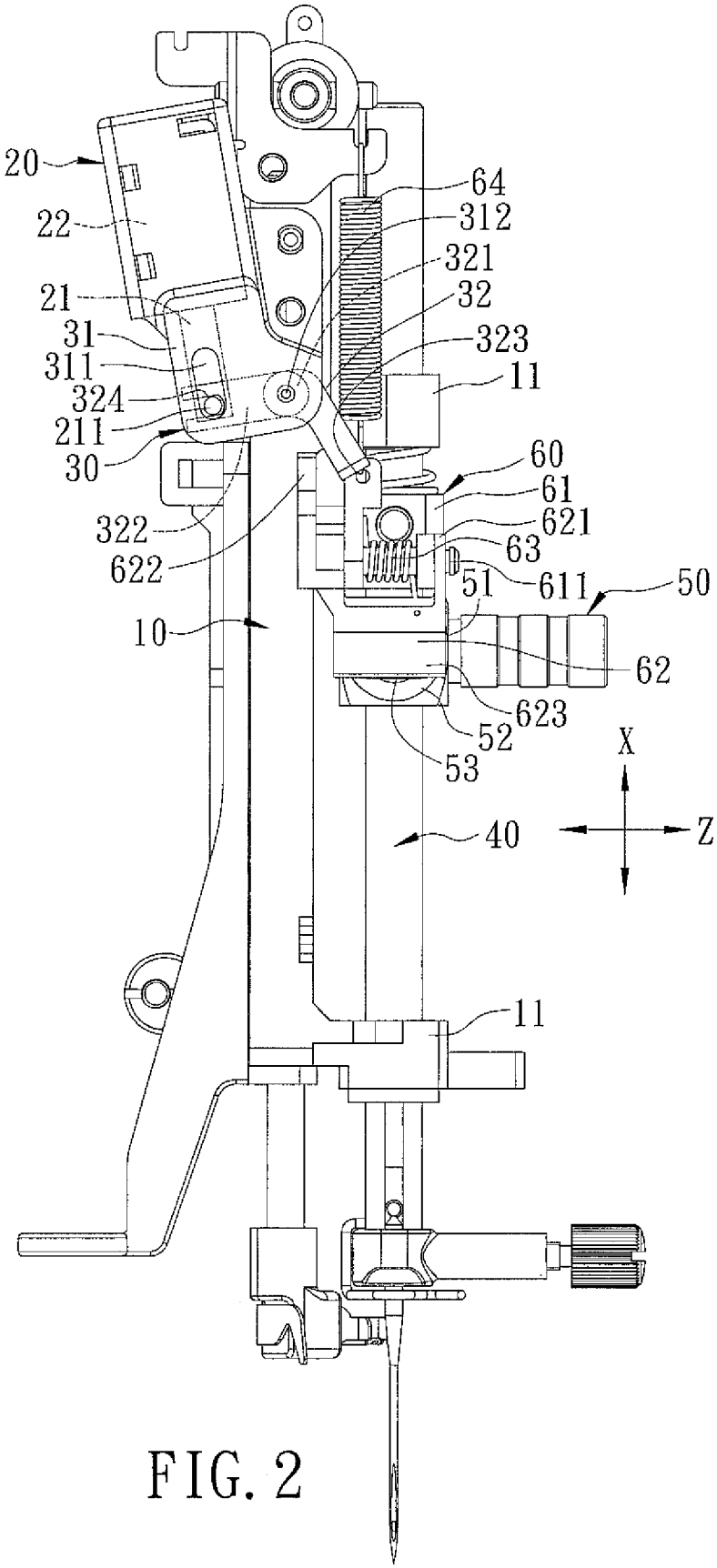
FIG. 2 is a front view of the preferred embodiment.
Figure 3:
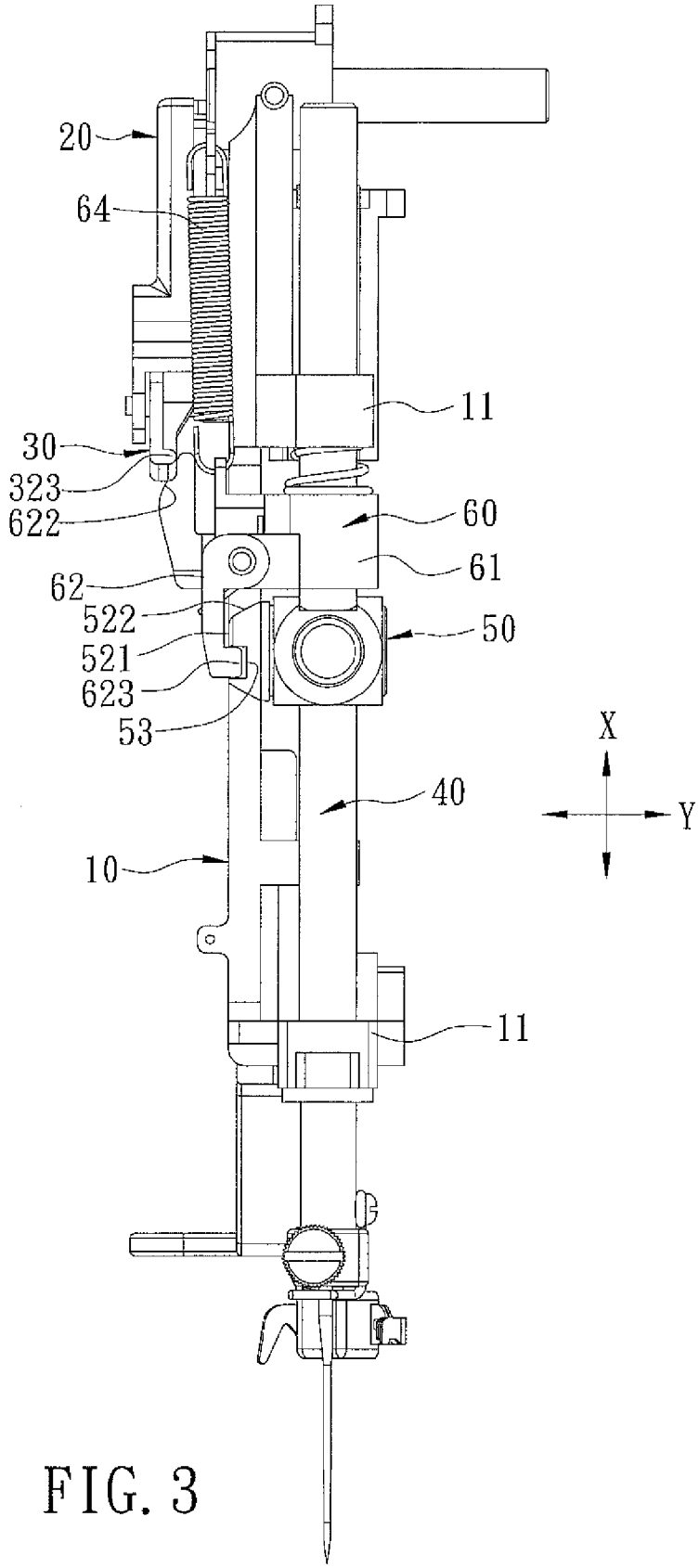
FIG. 3 is a side view of the preferred embodiment.
Figure 7:
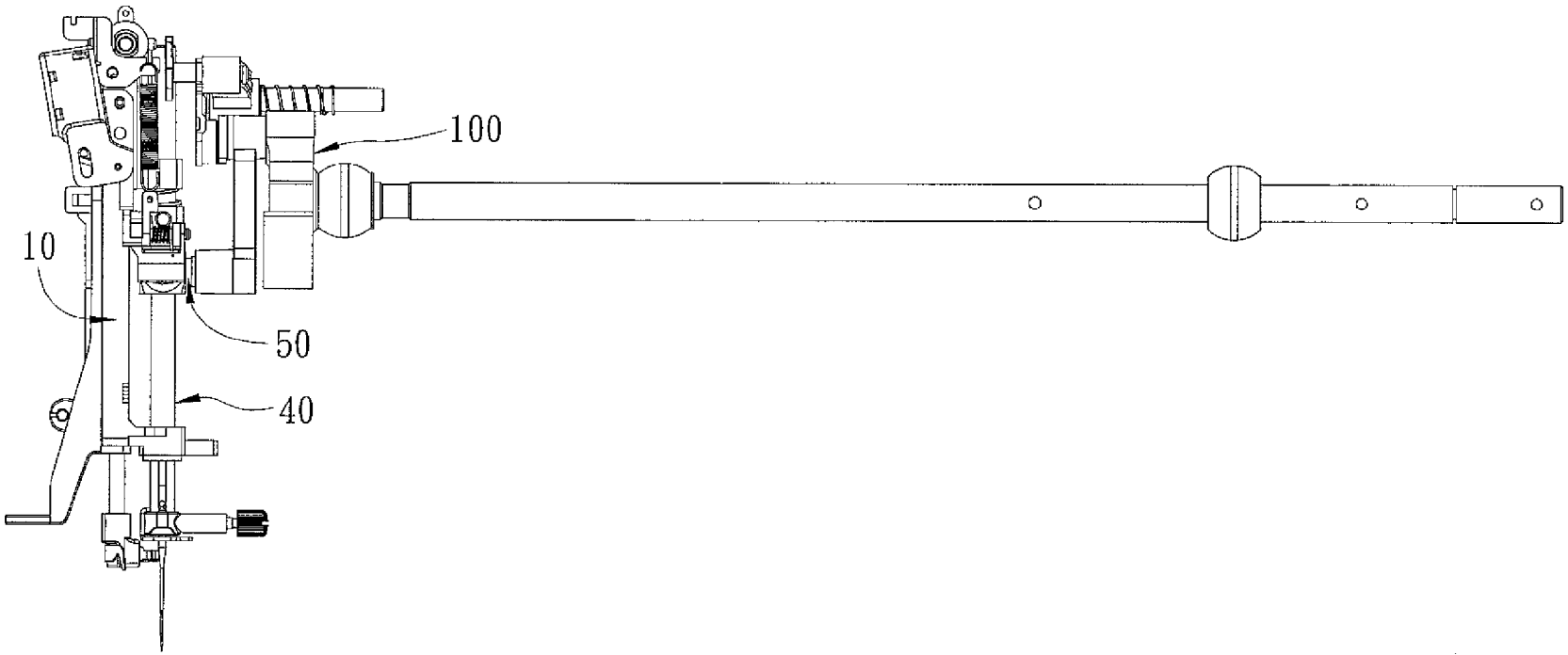
FIG. 7 is a front view showing the preferred embodiment mounted on a sewing machine.

Referring to FIGS. 1 to 3, the preferred embodiment of a clutch device according to the present invention is shown to be disposed between a needle bar 40 and a drive member 50, such as a driving shaft, of a sewing machine. The sewing machine generally includes a bed and a machine head spaced apart from the bed in a vertical direction (X) and having an elongated frame 10 which extends in the vertical direction (X) and which has two lugs 11. The needle bar 40 is mounted on and is movable relative to the pivot lugs 11 between upper and lower limits. The drive member 50 is actuated by a drive source 100 (see FIG. 7) in a known manner to move between upper and lower positions so as to transmit a reciprocating force to move the needle bar 40 between the upper and lower limits, and has a carrier end 51 slidable on the needle bar 40. The clutch device of this embodiment comprises an electromechanical unit 20, an actuating unit 30, a coupled portion 52, and a clutch unit 60.

The electromechanical unit 20 is mounted on an upper portion of the frame 10, and includes a solenoid coil 22 and a spring-loaded solenoid plunger 21 which is actuated by the solenoid coil 22 to move substantially in the vertical direction (X) and which has an engaging key 211 at a lower end thereof.

The actuating unit 30 includes a support 31 mounted on the frame 10 and below the electromechanical unit 20, and an actuating lever 32 disposed pivotally on the support 31. The support 31 has an elongated guide slot 311 such that the engaging key 211 of the plunger 21 extends through and is guided by the guide slot 311, and a fulcrum axle 312 disposed at a side of the guide slot 311 and extending in a transverse direction (Y). The actuating lever 32 has a fulcrum portion 321 pivotally mounted on the fulcrum axle 312 about a fulcrum axis, a power end 322 actuated by the electromechanical unit 20, and a weight end 323 disposed at an opposite side of the fulcrum portion 321 relative to the power end 322. The power end 322 has an engaging recess 324 which extends toward the fulcrum portion 321 and which is communicated with the guide slot 311 in the transverse direction. The weight end 323 is in the form of a rounded protrusion.

In this embodiment, the coupled portion 52 is integrally formed with the carrier end 51 of the drive member 50 to be moved with the carrier end 50 between the upper and lower positions, and has a front surface 521 which has a cavity 53.

The clutch unit 60 includes amounting seat 61 securely disposed on the needle bar 40, a clutch lever 62 pivotably mounted on the mounting seat 61 about a pivot axis oriented in a longitudinal direction (Z) transverse to the vertical and transverse directions (X, Y), a first biasing member 63 disposed to bias the clutch lever 62 with a biasing force, and a second biasing member 64 disposed between the frame 10 and the mounting seat 61 to bias the mounting seat 61 to slide toward an upper lug 11 of the frame 10.

Specifically, the mounting seat 61 has a pivot axle 611 extending along the pivot axis. The clutch lever 62 has a pivot portion 621 pivotably mounted on the pivot axle 611, and actuated and grasp ends 622, 623 disposed at two opposite sides of the pivot portion 621. The actuated end 622 is disposed to confront and to be engaged with the weight end 323. The grasp end 623 is disposed to confront the front surface 521 of the coupled portion 52 in the transverse direction (Y), and has a protrusion configured to be fitted in the cavity 53.

As shown in FIGS. 1 to 3, when the plunger 21 is in an extended state where the engaging key 211 is loosely engaged with the engaging recess 324 to exert a pressing force on the power end 322 so as to move the power end 322 downwardly along the guide slot 311. At this stage, the weight end 323 is swung to an idle position, where the weight end 323 is disengaged from the actuated end 622. Meanwhile, by the biasing force of the first biasing member 63, the grasp end 623 is in a coupled state, where the grasp end 623 is engaged with the cavity 53 of the coupled portion 52. Thus, by means of connection of the clutch lever 62, the drive member 50, the mounting seat 61, and the needle bar 40 are connected together such that, when the drive member 50 is actuated by a drive source 100 (FIG. 7) to reciprocate between the upper and lower positions, a reciprocating force is transmitted to move the needle bar 40 between the upper and lower limits to thereby perform a sewing operation.

Figure 4:
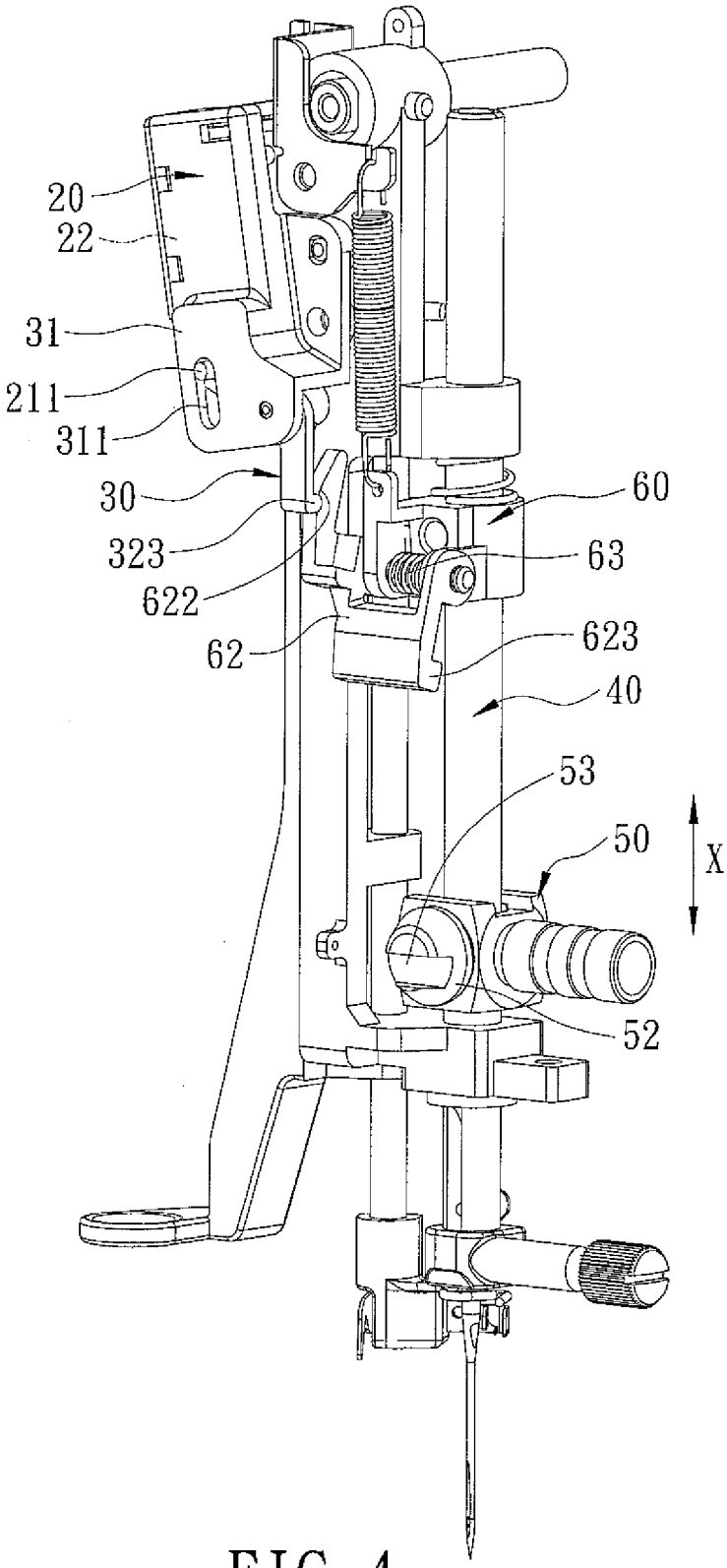
FIG. 4 is a perspective view of the preferred embodiment when a clutch lever in a decoupled state.
Figure 5:
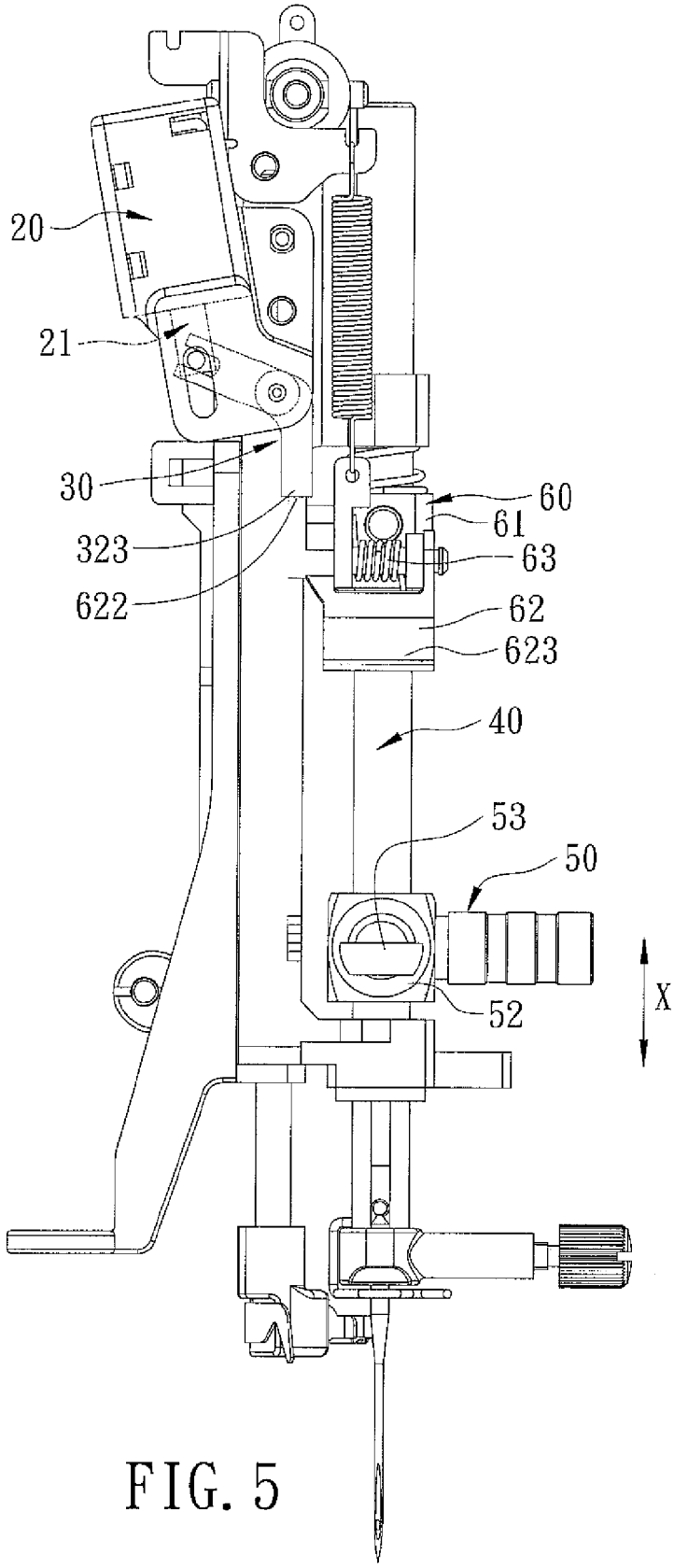
FIG. 5 is a front view similar to FIG. 2, showing the clutch lever in the decoupled state.
Figure 6:
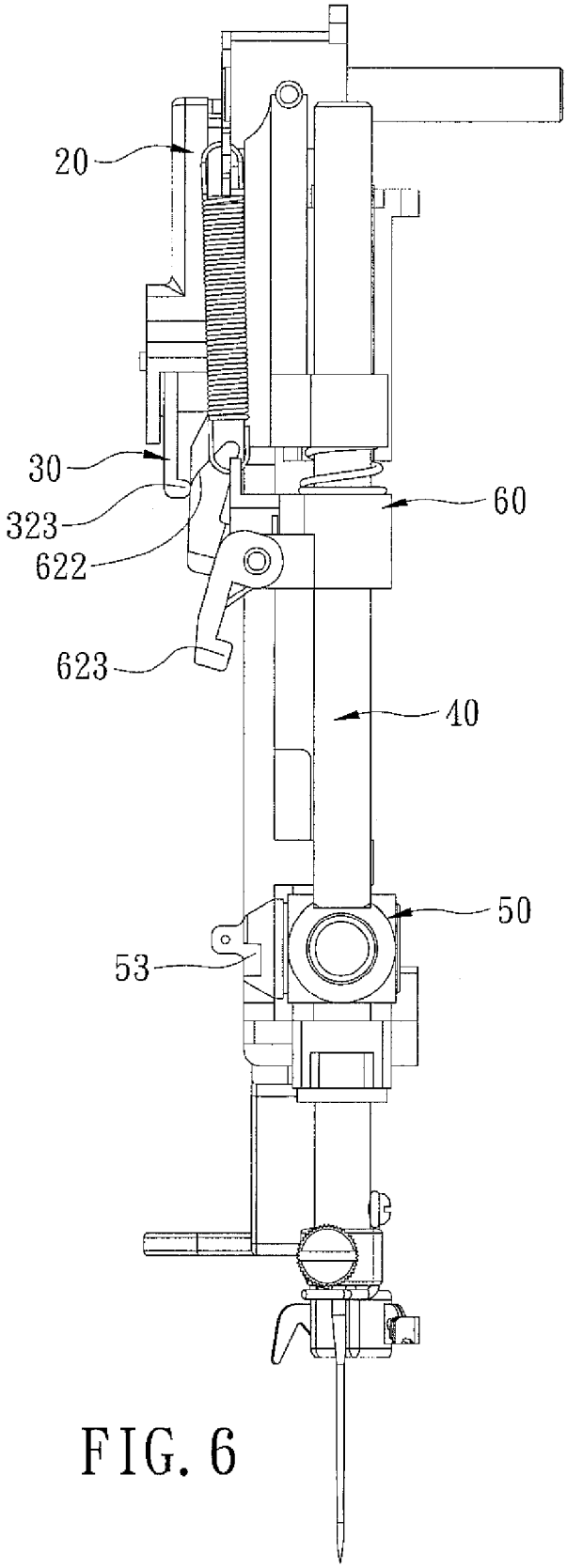
FIG. 6 is a side view similar to FIG. 3, showing the clutch lever in the decoupled state.

Referring to FIGS. 4 to 6, when it is desired to stop the movement of the needle bar 40, and when the drive member 50 is in the upper position, by means of a control unit (not shown), the solenoid coil 22 is actuated to bring the plunger 21 into a retracted state such that the weight end 323 is swung to an actuating position, where the weight end 323 is in pressing engagement with the actuated end 622 against the biasing force of the first biasing member 63. Hence, the grasp end 623 is swung to a decoupled state, where the grasp end 623 is disengaged from the cavity 53 in the coupled portion 51 so as to disengage the drive member 50 from the clutch unit 60. At this stage, the needle bar 40 remains with the mounting seat 61 and the clutch lever 62 at the upper limit while the grasp end 623 is urged toward the needle bar 40 by the second biasing member 64. Due to disengagement of the grasp end 623 from the cavity 53, the drive member 50 is set free from the needle bar 40, and continues with the reciprocating movement along the needle bar 40 between the upper and lower positions by actuation of the drive source 100.

When the plunger 21 is actuated to return to the extended state, the weight end 323 is swung to be remote from the actuated end 622 so that the grasp end 623 is permitted to be engaged with the cavity 53 in the coupled portion 51 for performing a sewing operation. Preferably, the front surface 521 of the coupled portion 52 has an upper marginal region 522 which is inclined upward and toward the needle bar 40 so as to facilitate the coupled portion 52 to be thrust into engagement with the grasp end 623 against the biasing force of the first biasing member 63 upon displacement to the upper position.

As illustrated, by controlling the electromechanical unit 20 in which the plunger 21 is moved between the extended and retracted states, the actuating lever 32 can be swung between an idle position to leave the clutch lever 62 in the coupled state, and the actuating position to permit the clutch lever 62 to displace to the decoupled state so as to disable the transmission of the drive of the drive member 50 to the needle bar 40.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A clutch device used to couple/decouple a reciprocating force to/from a needle bar in a sewing machine, the sewing machine including a bed, a machine head spaced apart from the bed in a vertical direction, the needle bar mounted on and movable relative to the machine head between upper and lower limits, and a drive member which is actuated to move between upper and lower positions so as to transmit a reciprocating force to move the needle bar between the upper and lower limits, and which has a carrier end slidable on the needle bar, said clutch device comprising:

a coupled portion disposed to be moved with the carrier end between the upper and lower positions;

a clutch lever disposed to be pivotable relative to the needle bar about a pivot axis that is oriented in a longitudinal direction transverse to the vertical direction, and having actuated and grasp ends which are disposed at two opposite sides of the pivot axis, and which are configured such that said grasp end is swingable by actuation of said actuated end between a coupled state, where said grasp end is engaged with said coupled portion under a biasing force, thereby transmitting the reciprocating force to move the needle bar, and a decoupled state, where said grasp end is disengaged from said coupled portion;

a biasing member disposed to bias said grasp end to the coupled state with the biasing force;

an actuating lever disposed to be pivotable relative to the machine head about a fulcrum axis oriented in a direction transverse to the longitudinal and vertical directions, and having power and weight ends which are configured such that said weight end is swingable by actuation of said power end between an idle position, where said weight end is disengaged from said actuated end so as to leave said grasp end in the coupled state, and an actuating position, where said weight end is in pressing engagement with said actuated end against the biasing force, thereby displacing said grasp end to the decoupled state;

an electromechanical unit including a solenoid coil and a spring-loaded solenoid plunger which is configured to exert a pressing force on said power end so as to displace said weight end to the actuating position; and a support adapted to be mounted on the machine head and below said electromechanical unit such that said actuating lever is disposed pivotally on said support, and having an elongated guide slot, said power end having an engaging recess which extends toward the fulcrum axis and which is communicated with said guide slot in the transverse direction, said solenoid plunger having an engaging key which extends through and guided by said guide slot and which is loosely engaged with said engaging recess to move along said guide slot by actuation of said solenoid coil so as to exert the pressing force on said power end;

wherein said power and weight ends of said actuating lever are disposed at two opposite sides of the fulcrum axis.

2. The clutch device according to claim 1, wherein said coupled portion has a front surface which confronts said grasp end in the transverse direction, and which has a cavity, said grasp end having a protrusion configured to be fitted in said cavity in the coupled state.

3. The clutch device according to claim 2, wherein said front surface has an upper marginal region which is inclined upward and toward the needle bar so as to facilitate said coupled portion to be thrust into engagement with said grasp end against the biasing force of said biasing member upon displacement to the upper position.

* * * * *